US005749573A

United States Patent [19]

Kobayashi

[11] Patent Number: 5,749,573

[45] Date of Patent: May 12, 1998

[54] SORTER WITH DIFFERENT BIN POSITIONS

[75] Inventor: Misao Kobayashi, Yamanashi, Japan

[73] Assignee: Nisca Corporation, Yamanashi-ken, Japan

[21] Appl. No.: 701,678

[22] Filed: Aug. 22, 1996

Related U.S. Application Data

[62] Division of Ser. No. 226,626, Apr. 12, 1994, Pat. No. 5,607,147.

[30] Foreign Application Priority Data

May 27, 1993 [JP] Japan ..... 5-148667
Nov. 24, 1993 [JP] Japan ..... 5-319149

[51] Int. Cl.[6] ..... B65H 39/10

[52] U.S. Cl. ..... 271/293; 271/294

[58] Field of Search ..... 271/292–294

[56] References Cited

U.S. PATENT DOCUMENTS 4,687,191 8/1987 Stemmle ..... 271/293 X
5,524,873 6/1996 Hosoi et al. ..... 271/293 X

*Primary Examiner*—Boris Milef
*Attorney, Agent, or Firm*—Kanesaka & Takeuchi

[57] ABSTRACT

A sorter for receiving sheets supplied from a sheet supply machine is formed of a sheet distributing section for distributing sheets supplied from the sheet supply machine, a plurality of bins situated near the sheet distributing section for receiving the sheets from the sheet distributing section, and a positioning device for positioning the bins to a home position, a sheet receiving position and a sheet taking position. The bins are arranged adjacent to each other and are movable relative to the sheet distributing section. The home position is located at one side of the sheet distributing section, wherein the bins are stacked adjacent to each other with a distance (L1) away from each other. All the bins may be located in the home position. The sheet receiving position faces the sheet distributing section to receive the sheet onto the bin, wherein a sheet receiving bin except a top bin is situated away from a bin located above the sheet receiving bin with a distance (L2). The sheet taking position is located above the sheet receiving position, wherein the bins are stacked adjacent to each other with a distance L3. The distance L3 is greater than the distance (L1), and less than the distance (L2).

16 Claims, 10 Drawing Sheets

SORTER WITH DIFFERENT BIN POSITIONS

CROSS REFERENCE TO RELATED APPLICATION

This is a divisional application of Ser. No. 08/226,626 filed on Apr. 12, 1994, now U.S. Pat. No. 5,607,147.

BACKGROUND OF THE INVENTION AND RELATED ART STATEMENT

The present invention relates to a sorter for receiving sheets from a sheet supply machine, such as a copy machine, which includes a plurality of bins free-movably situated adjacent to each other, and a distributing section for distributing the sheets to the bins.

As a sorter having a plurality of bins free-movably situated adjacent to each other and a distributing section for distributing sheets to the bins so that the sheets supplied from a sheet supply machine, such as a copy machine, are distributed to the bins, there is a machine disclosed in Japanese Patent Publication (KOKAI) No. 1-203166.

In the above publication, a plurality of bins is supported on a support frame, wherein the bins move upwardly as a whole from a lower home position while receiving the sheets one by one. The distance from a sheet receiving bin to the adjacent upper and/or lower bin is made wider than the distance between the bins in other positions. Namely, the distances between the bins before and after receiving the sheets are arranged equally.

In case the distance between the bins is made wide in order to easily take out the sheets from the bin, it requires a large space for the sorter. On the other hand, in case the distance between the bins is made narrow, it is inconvenient to take out the sheets from the bins though the space as a sorter is saved.

In Japanese patent publication (KOKAI) No. 63-267665, the bins are arranged vertically, and the bins except for the bins selected to be used are stacked at a lower position for waiting, while the upper space is divided equally for the bins to be used. In this technique, the device can be made small, but the publication does not disclose how the used bins are returned to the lower waiting position.

Also, Japanese Patent Publication (KOKAI) No. 4-75961 discloses a technique such that a plurality of bins is controlled to move vertically by three cam screws, wherein only when the sheet is received and only at a post-processing stage, such as stapling, the distance between the bins is made wider than other positions. However, the other positions are not specified. Also, there is no disclosure about the sheet receiving position and operation thereof.

The present invention has been made with reference to the problems described above, and the object of the invention is to provide a sorter, wherein the sheets can be surely supplied to the selected bins while the sheets received in the bins can be taken out easily.

Another object of the invention is to provide a sorter as stated above, wherein the limited space for the sorter can be utilized efficiently.

A further object of the invention is to provide a sorter as stated above, which is made compact and is provided with a large number of bins.

Further objects and advantages of the invention will be apparent from the following description of the invention.

SUMMARY OF THE INVENTION

A sorter of the invention is used together with a sheet supply machine, such as a copy machine. The sorter is formed of a sheet distributing section for distributing sheets supplied from the sheet supply machine, a plurality of bins situated near the sheet distributing section for receiving the sheets from the sheet distributing section, and means for positioning the bins to a home position, a sheet receiving position and a sheet taking position. The bins are arranged adjacent to each other and are movable among the three positions.

The home position is located at one side relative to the sheet distributing section, wherein the bins are stacked adjacent to each other with a distance L1 away from each other.

The sheet receiving position faces the sheet distributing section to receive the sheet onto the bin, wherein a sheet receiving bin is situated away from a bin located above the sheet receiving bin with a distance L2.

The sheet taking position is located at a side opposition to the home position relative to the sheet receiving position, wherein the bins are stacked adjacent to each other with a distance L3. The distance L3 is greater than the distance L1, and the distance L2 is greater than the distance L3.

When the sorter is actuated, the positioning means operates to move the bins successively from the home position to the sheet taking position through the sheet receiving position to place the sheets on the respective bins. The positioning means also return the bins to the home position.

The bins may be positioned to an upper gathering position located above the sheet taking position, wherein the distance between the bins at the upper gathering position is less than the distance L3. Also, the sorter may further include sheet presence detecting means for detecting whether any one sheet is placed on the bins at the sheet taking position and the sheet receiving position.

DETAILED DESCRIPTION OF PREFERRED EMBODIMENTS

With reference to the drawings, the embodiments of the present invention are explained.

FIGS. 1–6 shows a first embodiment. In this embodiment, a copy machine A is used as a sheet supply machine, and a sorter 10 is used for sorting and receiving means for copied sheets ejected from the copy machine.

Since the main structure of the copy machine A is known already, the explanation thereof is omitted. However, the copy machine includes a specific device for attaching to and detaching from the sorter 10.

Figure 1:
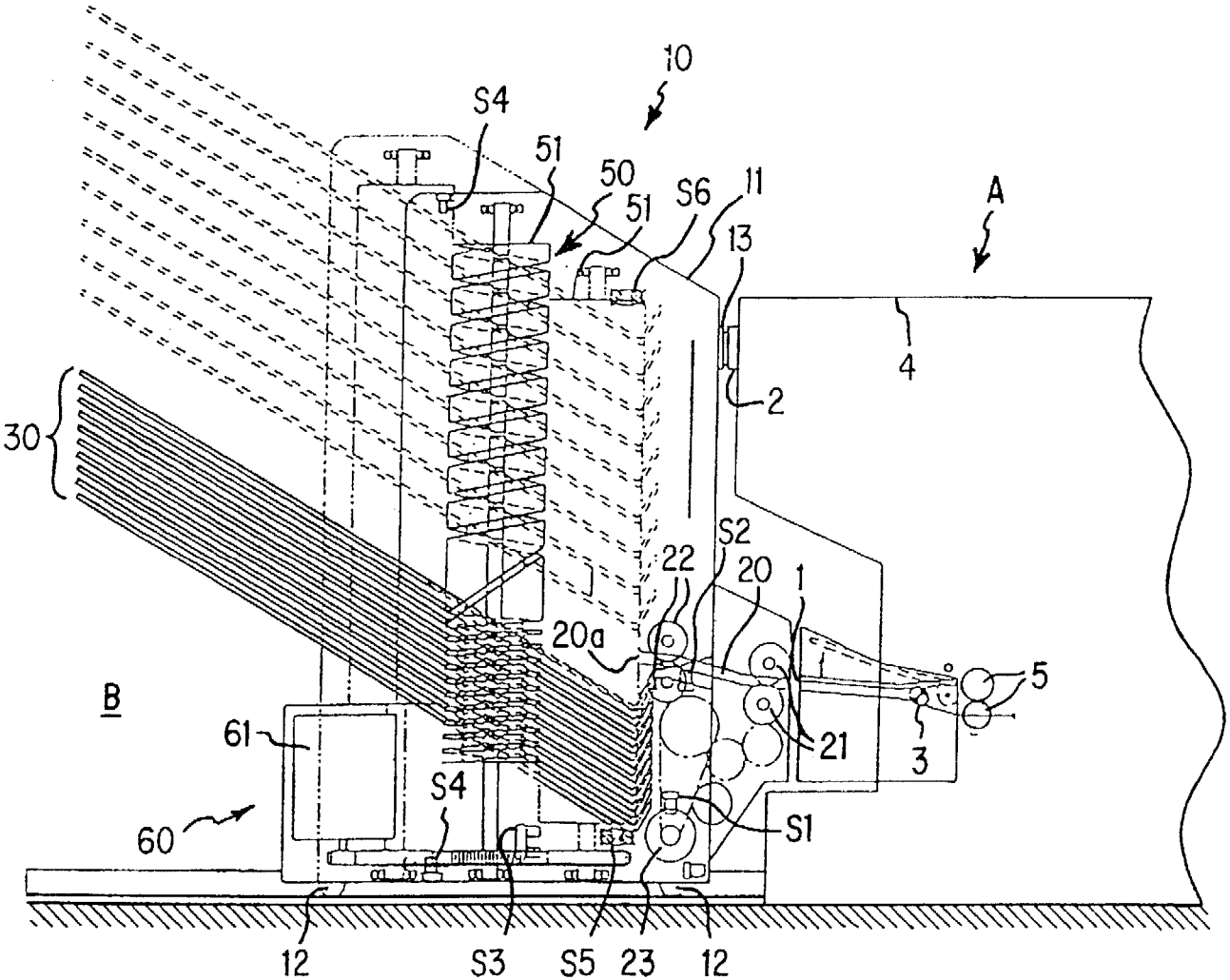
FIG. 1 is a side view of a first embodiment of a sorter of the invention attached to a copy machine.

Namely, a base 14 of a cover 11 of the sorter 10 is provided with casters 12 so that the sorter 10 can be moved freely. Also, a magnet 13 is attached to the cover 11 at a portion facing the copy machine A, as shown in FIG. 1. Thus, when the sorter 10 is moved toward a paper ejecting portion 1 of the copy machine A, the magnet 13 is attracted to a member 2 corresponding to the magnet 13 formed at the copy machine A, so that the sorter 10 is automatically connected to the copy machine A.

Figure 2:
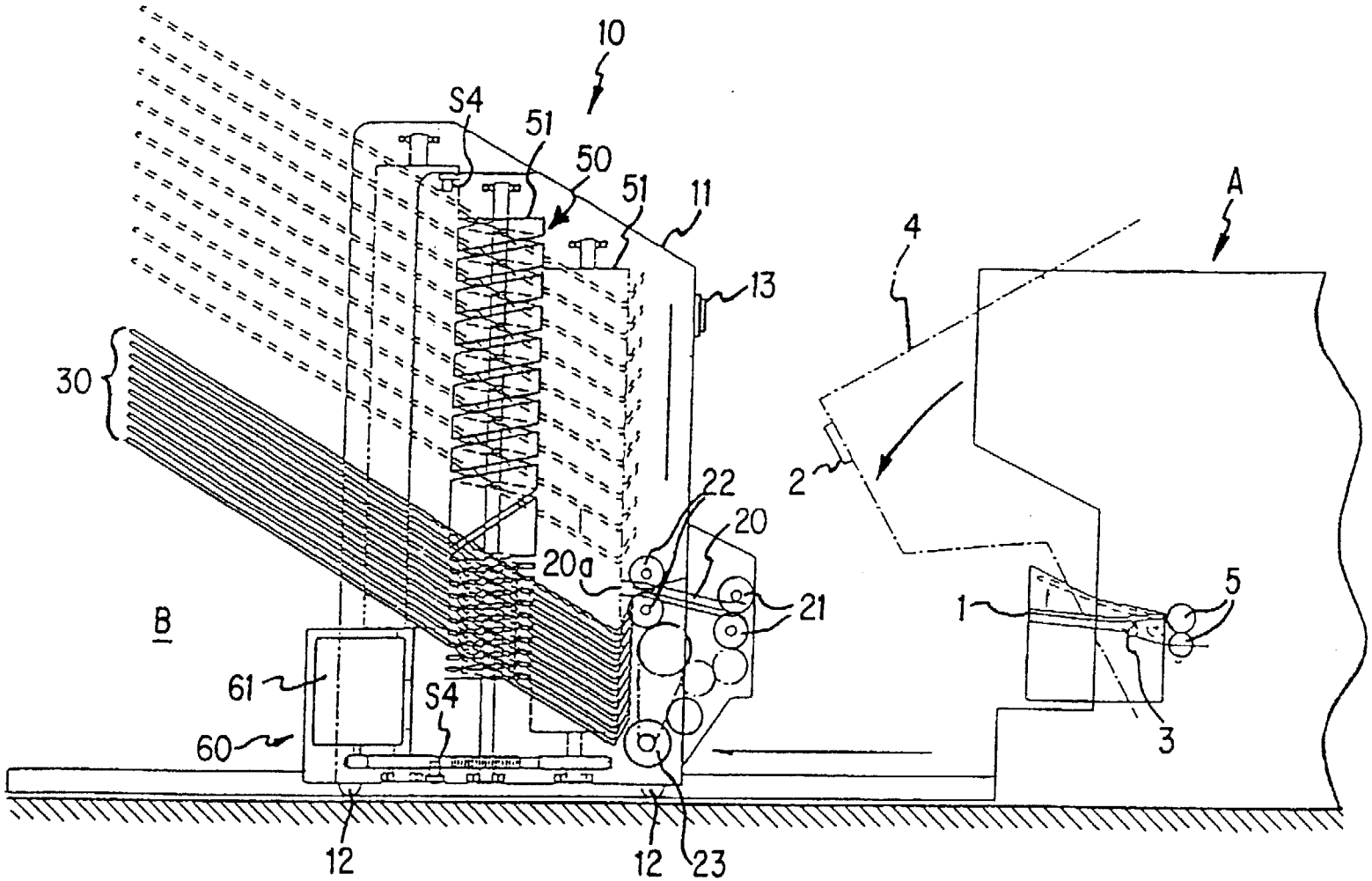
FIG. 2 is a side view for explaining a condition that the sorter is separated from the copy machine.

On the other hand, the copy machine A includes a cover 4 rotatable around a support portion 3, as shown in FIG. 2. Thus, when the cover 4 is opened, the magnet 13 of the sorter 10 is detached from the copy machine, and the sorter 10 is automatically removed from the copy machine. Thus, fixing, such as paper jam, of the copy machine can be made smoothly.

In the copy machine A, a copied sheet (herein after called "sheet") is ejected to the sorter 10 through the paper ejecting portion 1 by means of a pair of ejecting rollers 5.

Figure 4:
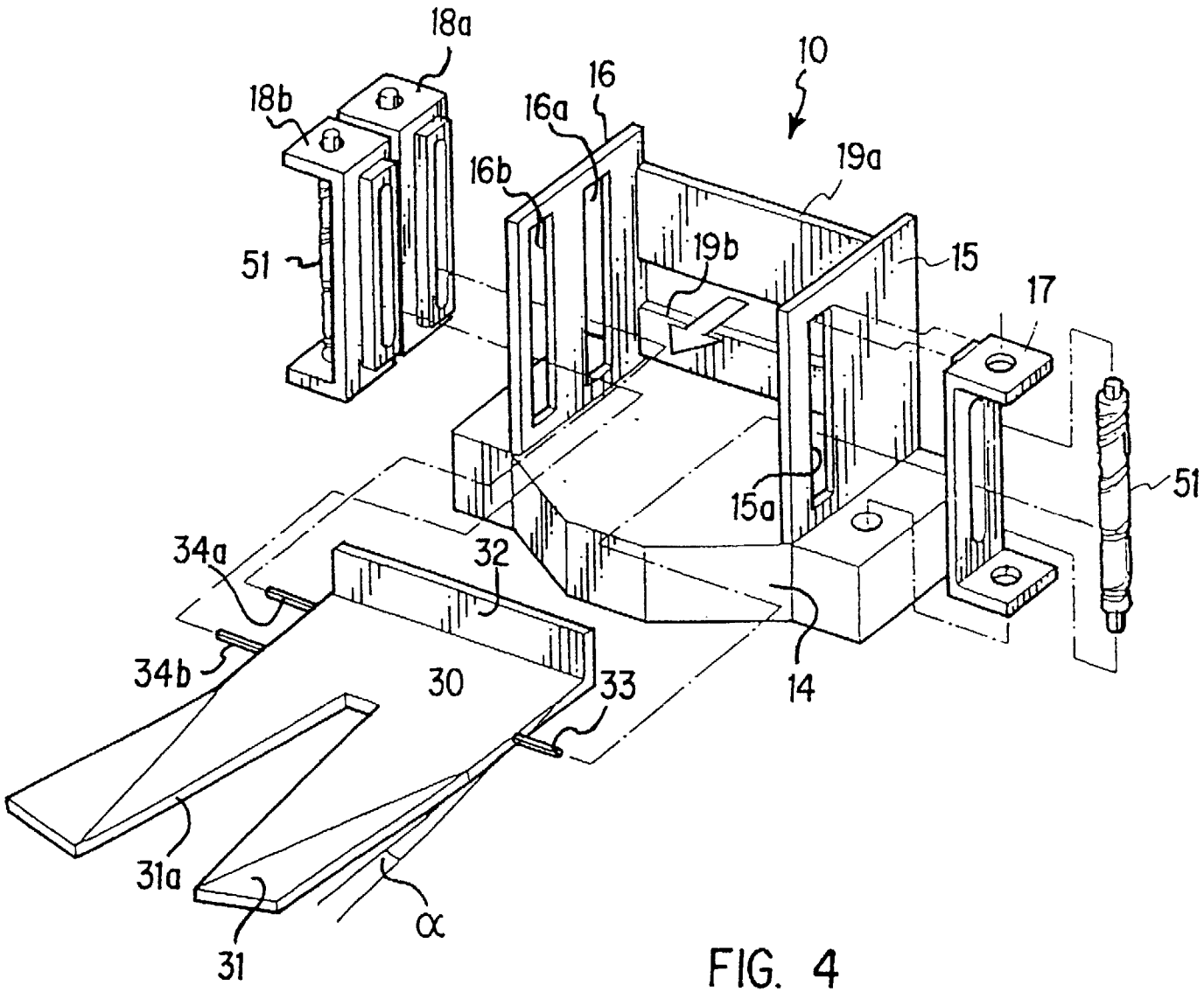
FIG. 4 is an exploded view for showing an assembly of the bin and the spiral cams.

As shown in FIG. 4, the sorter 10 is provided with a plurality of bins 30 inside a pair of side plates 15, 16 disposed on the base 14. Incidentally, the cover 11 is not shown in FIG. 4. Also, the side plates 15, 16 are securely connected together by connecting members 19*a*, 19*b*.

In a long hole 15*a* of the side plate 15, a support member 17 is inserted and fixed therein. The support member 17 rotationally supports a spiral cam 51 constituting bin positioning means explained later. The other side plate 16 includes two long holes 16*a*, 16*b*, in which the similar support members 18*a*, 18*b* are inserted and fixed therein.

A feeding path 20 for receiving the sheet from the paper ejecting portion 1 and transferring the sheet inside the feeder 10 is formed at a front portion facing the copy machine. An exit of the feeding path 20 at the side of the bin 30 is a distributing portion 20*a*.

A pair of receiving rollers 21 and a pair of distributing rollers are situated at the inlet side and the distributing portion 20*a* of the feeding path 20, respectively. The rollers 21, 22 are driven by a feeding motor 23 and a series of belts and gear train. The feeding motor 23 is provided with a speed sensor S1, and a feed/eject sensor S2 for constituting distribution detecting means is formed at a portion before the distributing rollers 22. The feed/eject sensor S2 has a function for counting a number of sheets passing through the distribution portion 20*a*.

In the embodiment, ten bins 30 are vertically arranged adjacent to each other, wherein the bins are called $\mathbf{30}_1$, $\mathbf{30}_2$, . . . $\mathbf{30}_{10}$ from the upper bin to the lower bin in order.

Figure 5:
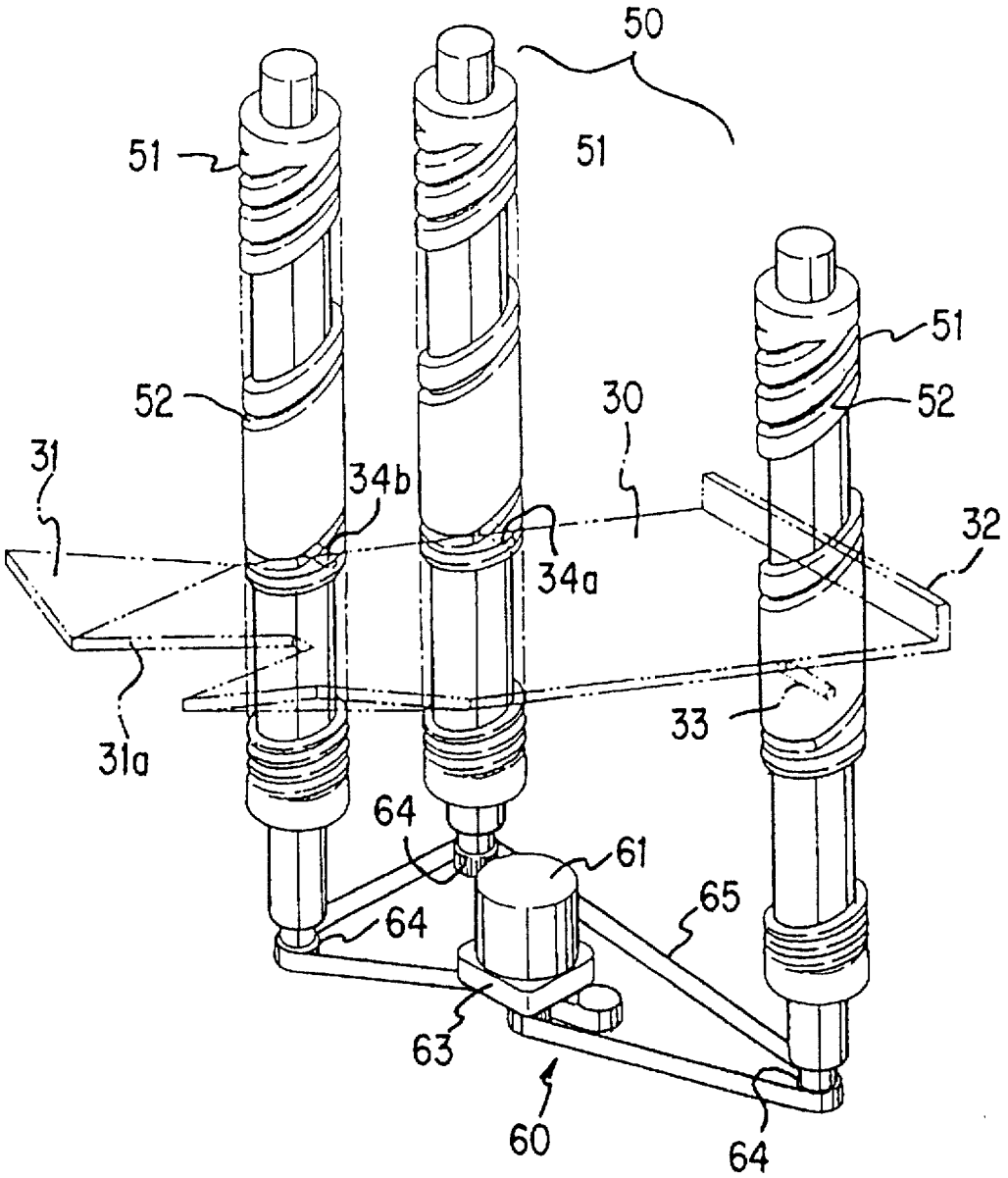
FIG. 5 is an explanatory view of an assembled condition of the bin, bin positioning means and a driving device.
Figure 6:
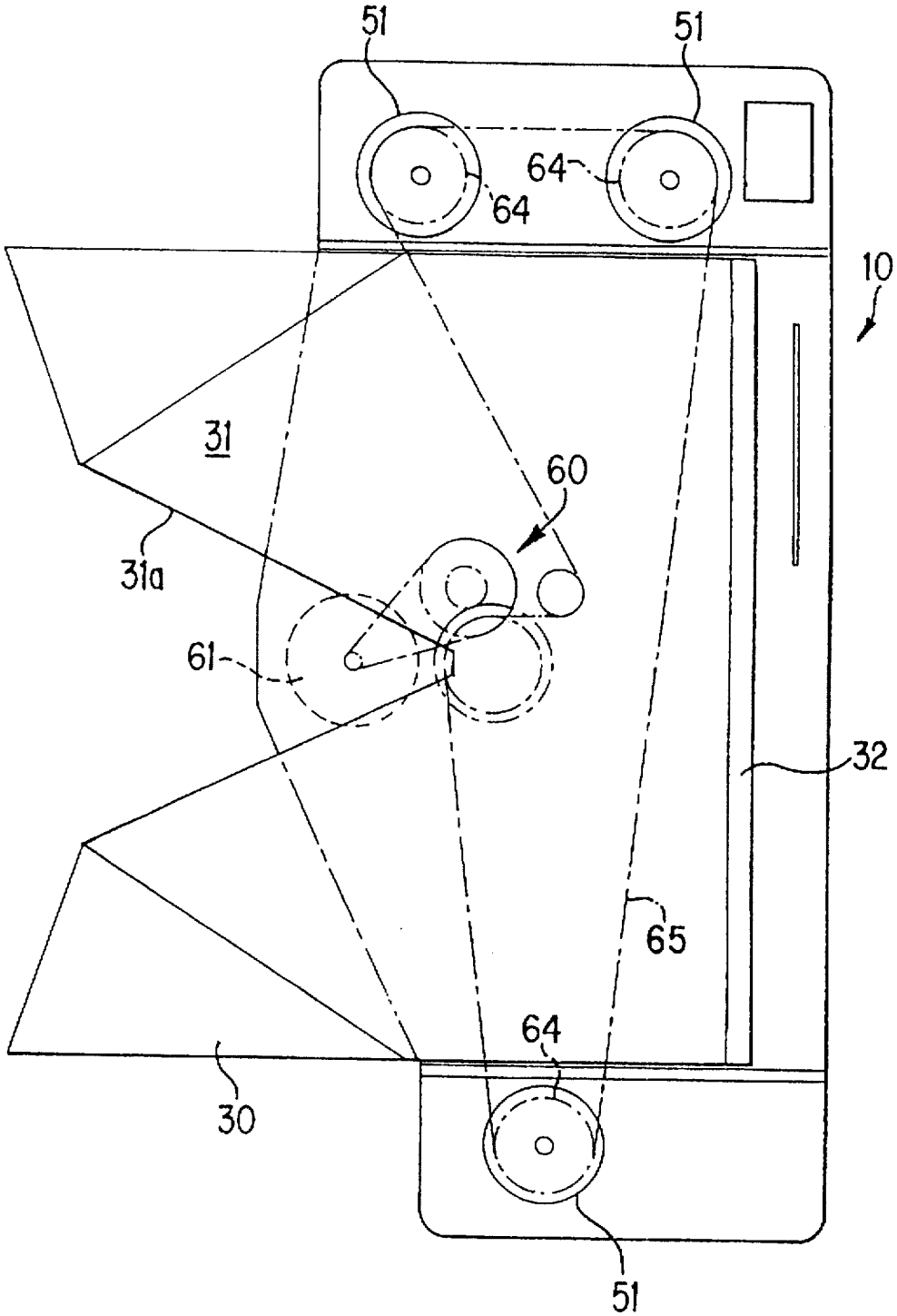
FIG. 6 is a plan view of the sorter.

As shown in FIGS. 4, 5 and 6, each bin is formed of a mounting portion 31 having a cutout 31*a* deeply cut, and a receiving portion 32 for receiving a front end of the sheet for registration. Engaging pins 33, 34*a*, 34*b* engaging cam grooves 52 of the spiral cams 51 explained later project from side edges of the mounting portion 31. Although it is not shown in the drawings, the engaging pins receive free rotational cam followers thereon in order to smoothly slide in the cam grooves 52.

Now, definition of the front and rear edges of the sheet, as well as the front and rear edges of the bin 30 in the embodiment is made.

When the sheet is moving along the feeding path 20, the front and rear edges of the sheet are determined along the moving direction of the sheet. However, after the rear edge of the sheet has left the distributing rollers 22, the front and rear edges are used reversely, wherein the front edge upto that moment is called a rear edge or rear portion, and the rear edge upto that moment is called a front edge or front portion. In order to correspond to the definition of the front and rear edges of the sheet, in the bin 30, the side at the receiving portion 32 is called a front edge, forward portion or front portion, and the opposite side is called a rear edge or rear portion. This definition is applied to the whole sorter, wherein a side facing the copy machine A is called a front side, and the opposite side is called a rear side. The definition comes from an idea such that the sorter 10 is viewed as a center, and is an additional device for the copy machine A.

Figure 3:
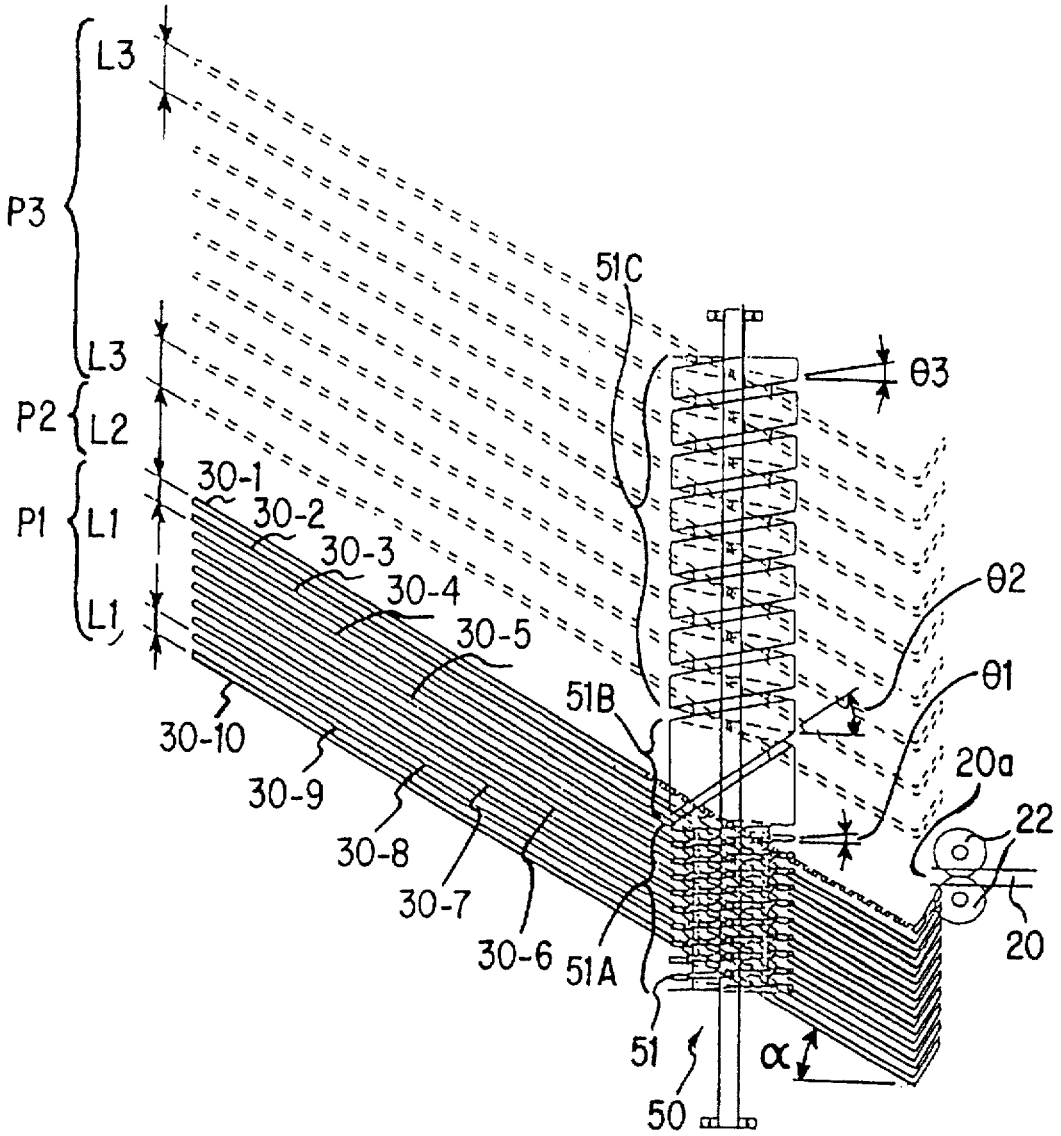
FIG. 3 is an explanatory view for showing a relationship between bins and a spiral cam.

As shown in FIGS. 1 and 3, the bin 30 is arranged such that the mounting portion 31 is located above the receiving portion 32 or the front portion to have an inclination angle alpha. In the embodiment, the inclination angle alpha is about 30 degrees, and a space B is formed under the bottom bin $\mathbf{30}_{10}$. Although it is not shown in the drawings, the inclination angle of the bin 30 may be made less near the distribution portion in order not to prevent the entry of the sheet, and then, the inclination angle is increased to have above 30 degrees, finally.

The movement of the bin 30 is controlled by the bin positioning means 50, as explained below.

The bin positioning means 50 is formed of three spiral cams 51 vertically arranged and rotationally supported by the support members 17, 18*a*, 18*b*, and driving means 60 including a driving motor 61, drive transfer members and so on.

The spiral cam 51 includes spiral cam portions 51A, 51B, 51C having three different leading angles around the cylindrical surface thereof, as shown in FIG. 3. The leading angles of the cam portions 51A, 51B, 51C are theta 1, theta 2 and theta 3, respectively, and have a relationship of theta 2>theta 3>theta 1.

As state d above, the leading angle theta 1 of the can portion 51A is small, and the distance between the bins 30 is the minimum distance L1 in order to hold the maximum number of the bins. The cam portion 51A has a groove number of the cam groove 52 corresponding to the number of the bins 30 (ten in the embodiment). This position P1 is called a home position of the bins 30.

The leading angle of the next cam portion 51B is made maximum, and the distance L2 is maximum, as shown in FIG. 3. When the bin 30 is in this position P2, the bin receives the sheet. The position P2 is called a sheet receiving position. Incidentally, the number of the cam groove 52 in the sheet receiving position P2 is one, i.e. one revolution.

In the cam portion 51C, the leading angle of theta 3 is greater than the leading angle theta 1 at the home position P1, and less than theta 2 at the sheet receiving position P2, so that the received sheets can be taken out easily. Therefore, the position P3 is called a sheet taking position. Incidentally, as shown in FIG. 3, number of the cam groove 52 is nine to receive nine bins, which is one less than the total number. This is because the bin is always located at the sheet receiving position P2 for receiving the sheet.

The revolution phases of the spiral cams 51 are the same in order to provide the inclination angle alpha for all the bins 30, and the bins 30 are held in the grooves to be vertically spaced apart from each other. The spiral cams 51 are rotationally supported by the support members 17, 18*a*, 18*b*.

As shown in FIG. 1, the driving motor 61 of the driving means 60 is located in the space B under the bottom bin $\mathbf{30}_{10}$ and in the middle of the width direction of the bin 30 (FIG. 6). Thus, a dead space under the bin is well utilized to thereby contribute to form the sorter small.

The drive transfer members are formed of a driving pulley 63 attached to an output shaft of the driving motor 61, belt pulleys 64 fixed to the respective shafts of the spiral cams 51, and a belt with teeth wound around the pulleys 63, 64.

As shown in FIG. 1, the sorter includes a home position sensor S5, and an upper limit sensor S6. The home position sensor S5 detects the bottom bin $30_{10}$ when all the bins 30 are moved down and are located in the home position P1. The upper limit sensor S6 detects the upper limit of the uppermost bin when all the bins 30 are moved upward.

Although it is not shown in the drawings, in order to press and expand the sheets held in the bins when the bins are located at the home position P1, pressing members, such as sponges with a predetermined thickness, are adhered to the bottom surfaces of the mounting portions 31 of the bins 30.

S4 is a sheet presence detecting sensor for detecting if there is a sheet in any one of the bins 30, and is formed of a light emitting element and a light receiving element.

The operation of the sorter is explained below.

The sorter responds to a selection of a sorting mode or non-sorting mode at the copy machine. Also, the sorting mode includes a regular sorting for distributing one sheet to one bin, and a grouping for distributing the same pages to the same bins.

As shown in the solid line in FIG. 1, the bins 30 are at first located in the home position P1, wherein the uppermost bin $30_1$ is located also in the sheet receiving position P2. The space above the bin $30_1$ is widely opened.

Therefore, if the non-sorting mode is selected, the sheet is received in the first bin $30_1$ as it is. If a space for receiving the sheets is insufficient in the bin $30_1$ only, the first bin $30_1$ is moved upwardly by operating the spiral cams 51 automatically or by means of a manual bottom (not shown). As a result, the bins below the second bin $30_2$ rise, and the second bin $30_2$ is located in the sheet receiving position P2, so that the sheets may be distributed as they are.

In the grouping mode in the sorting mode, transfers of the bins 30 are made automatically for the number of the pages indicated manually or a signal from the copy machine A in the non-sorting mode.

Namely, the sheet transferred from the copy machine A is detected by the sensor S2 located before the distributing rollers 22, so that the feeding motor 23 starts to operate, and the sheet is transferred to the first bin $30_1$ by the distributing rollers 22. When a predetermined number of the sheets is transferred to the first bin $30_1$, the driving motor 61 for the bin positioning means 50 actuates by the signal from the sensor S2. Thus, the spiral cams 51 rotate for one revolution, so that the first bin $30_1$ rises, and the second bin $30_2$ comes to the sheet receiving position P2, to which the sheets for the second page are supplied.

As stated above, when a predetermined number of pages has been transferred, the sorting is completed. When the sorting is completed, the bins 30 containing the sheets therein are positioned at the sheet taking position P3, which is shown in chain lines in FIG. 1. In this position, the bins are properly spaced apart from each other to facilitate removal of the sheets, wherein the space is not narrow and is not wide to occupy a large space.

The bins 30 not used for the above sorting operation rise for a number of revolutions of the spiral cams 51, wherein the uppermost bin 30 in the remaining bins is located at the sheet receiving position P2 and other remaining bins are located in the home position P1.

Then, an operator removes the sheets from the bins 30 moved up to the sheet taking position P3. When all the sheets are removed from the bins, the sheet presence sensor S4, which is return signal means, detects this situation, and outputs a return signal to the driving means 60 of the bin positioning means 50. By this return signal, the driving motor 61 rotates in a reverse direction, and all the bins 30 located at the sheet taking position P3 return to the home position P1.

Next, the sorting operation is explained.

In case of the sorting, the sheets in every pages are supplied to the bins. Thus, the first sheet or a sheet of a first page is initially received in the bins in order from the first bin $30_1$ to a bin corresponding to the desired number of sets, for example the fifth bin $30_5$. The rising operation of the respective bins $30_1$–$30_5$ is the same as explained in the grouping, but when the fifth bin $30_5$ receives a sheet, the fifth bin $30_5$ stays in that sheet receiving position P2. And at that position, the bin $30_5$ receives a second sheet.

In particular, after a few moment later when the rear end of the first sheet of the first page is detected by the sensor S2, the driving motor 61 rotates in the forward direction by the signal of the sensor S2. Thus, the first bin $30_1$ is transferred to the sheet taking position P3, and the second bin $30_2$ rises to the sheet receiving position P2. In this position, the second sheet of the first page is supplied to the second bin $30_2$, and similarly, the sheets are supplied to the respective bins.

In case the sheets of the second page are distributed, for a moment later when the rear end of the first sheet of the second page is detected by the sensor S2, the driving motor 61 rotates in the reverse direction by the signal of the sensor S2. Thus, the bins below the fifth bin $30_5$ are lowered, and the fourth bin $30_4$ descends to the sheet receiving position P2. Then, the second sheet of the second page is supplied to the fourth bin $30_4$.

Likewise, when the sheets of the second page are supplied up to the first bin $30_1$, the sheets of the third page are distributed in order from the first bin $30_1$, as in the distributing operation of the first page.

When the distributing page number is an odd number, the sheet receiving bins expect for the lowermost bin thereof ($30_1$–$30_4$) are located in the sheet taking position P3, and the lowermost bin $30_5$ is located in the sheet receiving position P2.

When all the sheets are removed from the respective bins 30, the sheet presence sensor S4 detects the sheet absent condition in the bins, by which the driving motor 61 rotates in the reverse direction. The bins are lowered down until the lowermost bin 30, i.e. $30_{10}$ in this embodiment, is detected by the home position sensor S5, and the motor stops where all the bins $30_1$–$30_{10}$ return to the home position P1.

In case the receiving or distributing page number is an even number, when the distributing operation has been completed, all the bins $30_1$–$^{30}{}_{10}$ are located in the home position P1. Thus, the driving motor 61 is rotated in the forward direction by a copy completing signal from the copy machine A or a signal from an operation button (not shown) or from the sensor S2 indicating that sensor S2 does not operate for a while. For example, when all the bins are used, all the bins are raised once up to the sheet taking position P3. In this case, the motor 61 stops automatically when the first bin $30_1$ is detected by the upper limit sensor S6. The operation thereafter is the same as in the odd number.

In the sorting operation, when the bins 30 are lowed down to the home position P1 while the sheets are held in the bins 30, the sheets held in the bins 30 are pushed by the pressing members fixed to the bins, so that even if the sheets are curved, the sheets are stretched. Thus, after the sheets are removed from the bins 30, the sheets can be handled easily.

Next, a second embodiment of the invention is explained with reference to FIGS. 7–10.

In this embodiment, a copy machine A is used for a sheet supply machine, as in the first embodiment, wherein a sorter 70 is used as sorting and storing means for the copied sheets ejected from the copy machine A. The sorter 70 has basically the same structure as in the sorter 10 of the first embodiment, so that the same numerals are used for the common members and sections as in the sorter 10.

Figure 7:
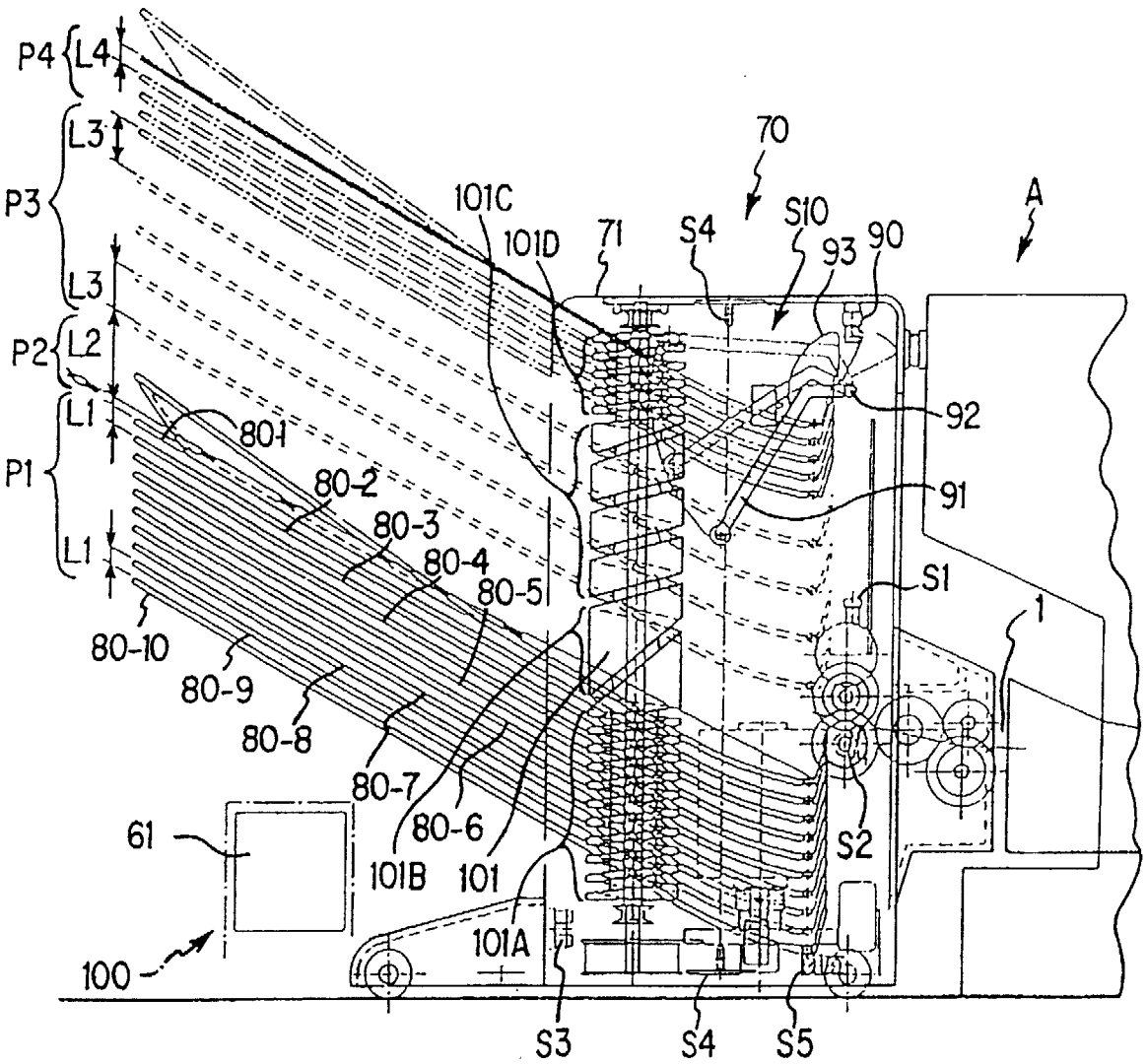
FIG. 7 is a side view of a second embodiment of a sorter of the invention.
Figure 8:
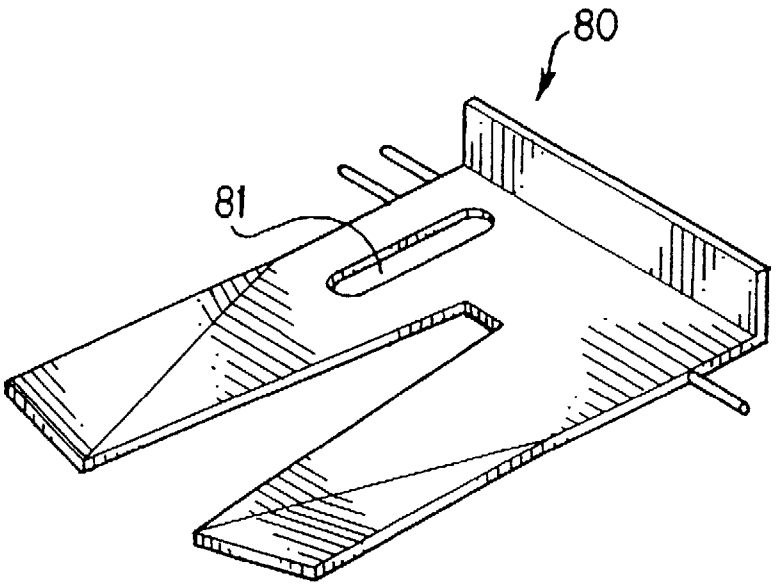
FIG. 8 is a perspective view of a bin of the second embodiment.

The sorter 70 is provided with a plurality of bins 80 inside a pair of side plates (not shown) formed on a base (not shown), and a main structure is covered by a cover 71. However, when the height of the cover 71 as shown in FIG. 7 is compared with that of the cover 11 of the sorter 10, it is clear that the overall height of this embodiment is substantially the same as that of the copy machine A, and is lower than that of the sorter 10 to become a compact machine. The reason thereof is explained later.

At a front portion facing the copy machine A, a feeding path 20 communicating with a paper ejecting portion 1 is formed, and an exit of the feeding path 20 at a side of the bin 80 becomes a distributing portion 20*a*. Also, the sorter 70 includes a pair of rollers 21, a pair of distributing rollers 22, a feeding motor 23 and a series of belts and a gear train for driving the rollers 21, 22, a speed sensor Si for the motor 23, a feed/eject sensor S2 as distribution detecting means situated before the rollers 22, and so on, as in the sorter 10.

In this embodiment, ten bins 80 are vertically arranged adjacent to each other, and it is called from the top to the bottom as the bin $\mathbf{80}_1$, $\mathbf{80}_2$ . . . $\mathbf{80}_{10}$. Each bin 80 has basically the same structure as in the bin 30 of the first embodiment, but one thing that the bin 80 has an opening 81 for a pivotable lever 91 which constitutes a single sheet presence sensor S10 explained later is different.

The single sheet presence sensor S10 is formed of, as shown in FIG. 7, a sensor body 90 as a photo coupler, the pivotable lever 91 pivotally supported at a support point 92 to be swingable in a vertical plane, a sector 93 fixed to a base of the pivotable lever 91 and crossing a light path of the photo coupler, and so on. In case a sheet exists in one of the bins 80, the opening 81 is closed and the pivotable lever 91 is raised, so that the light path of the photo coupler 90 is crossed by the sector 93 to thereby detect the presence of the sheet. In case there is no sheet in the bins 80, the pivotable lever 91 falls in the opening 81, so that the sector 93 leaves the light path of the photo coupler 90 to open to thereby detect none-sheet condition.

Bin positioning means 100 of the second embodiment is formed of three spiral cams 101 rotationally supported in support members, and driving means including a driving motor 61, drive transfer members 62 and so on.

The spiral cam 51 of the first embodiment has on the outer cylindrical periphery thereof the cam portions 51A, 51B, 51C having three different leading angles, as shown in FIG. 3, but the spiral cam 101 has four kinds of spiral cam portions 101A, 101B, 101C, 101D, which have leading angles from the bottom to the top in order of theta 1, theta 2, theta 3 and theta 4. The relationship of the leading angles is theta 2>theta 3>theta 1, and theta 1 nearly equals to theta 4. The distances between the respective bins have the relationship of L2>L3>L1, and the distance L1 is nearly equals to the bin distance L4 at an upper gathering position P4.

As explained above, the present embodiment has the upper gathering position P4 above the sheet taking position P3, which has the distance between the bins 80 substantially the same as that in the home position P1. In the embodiment, however, the upper gathering position P4 can retain five bins $\mathbf{80}_1$–$\mathbf{80}_5$, and the sheet taking position P3 can retain four bins $\mathbf{80}_6$–$\mathbf{80}_9$. Thus, the sorter 70 has ten bins 80 as in the sorter 10. Although a plurality of bins 80 can be located in the sheet taking position P3, the height of the sorter 70 can be made less than that of the sorter 10 to thereby make the sorter 70 compact.

As in the first embodiment, the sorter 70 is provided with a home position sensor S5 for detecting the lowermost bin $\mathbf{80}_{10}$ wherein all the bins 80 are located in the home position P1, and an upper limit sensor S6 for detecting the uppermost position of the bin $\mathbf{80}_1$ when all the bins 80 are moved upward.

In the invention, a control panel is formed of a plurality of interfaces with respect to CPU, and is controlled mainly by a software. The control panel is connected to the copy machine A by means of a cable, and includes external terminals for the feed/eject sensor S2. Although the sheet presence sensor S10 is used only in the second embodiment, the other sensors S1, S4, S5, S6 and so on are the same as in the first embodiment.

Figure 9:
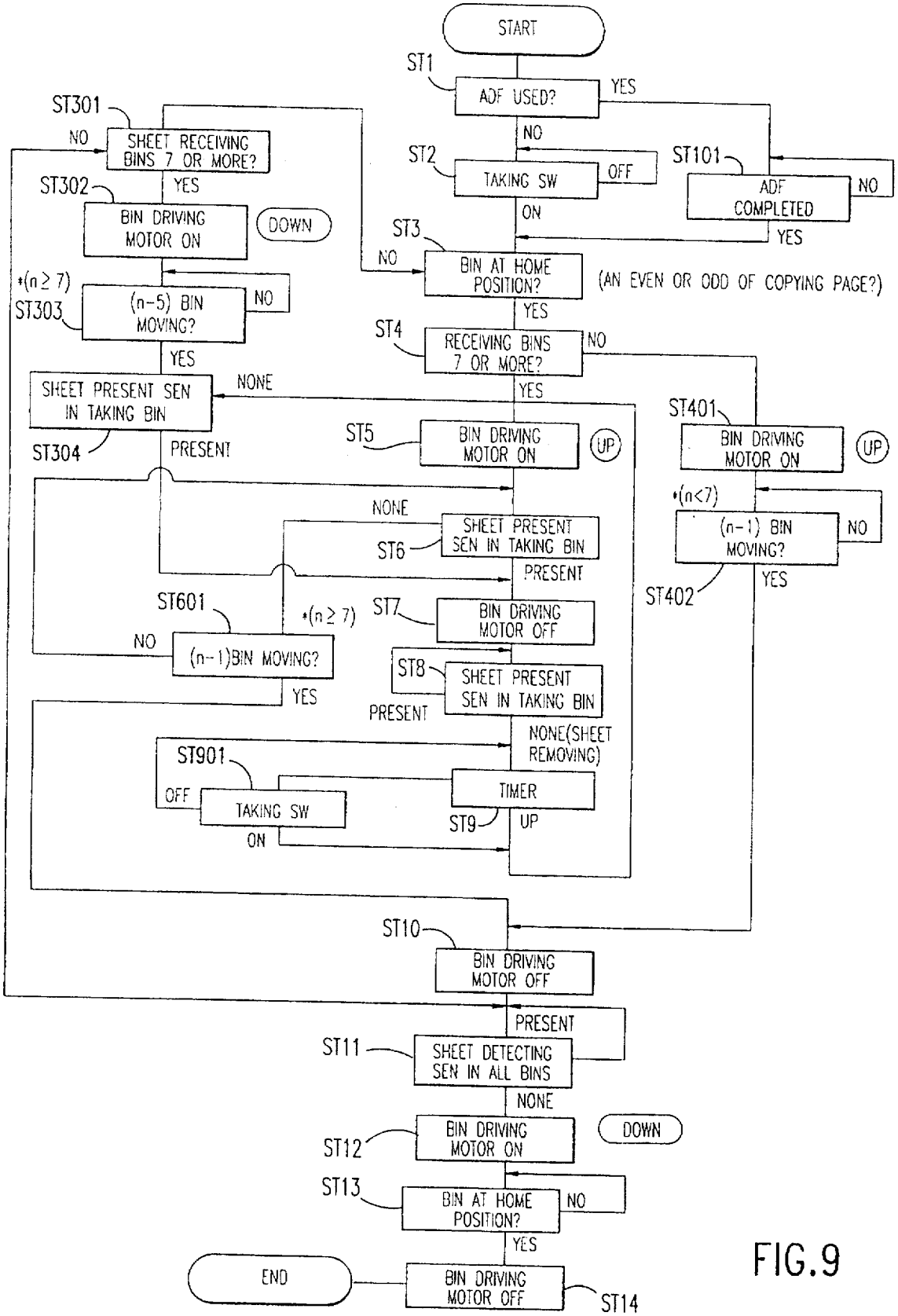
FIG. 9 is a flow chart of an operation of a sorter of the second embodiment.

Next, the operation of the second embodiment is explained with reference to FIG. 9.

The sheet receiving operation of the sorter 70 is the same as in the first embodiment, so that the explanation of the sheet receiving operation is omitted. The sheet taking operation is mainly explained with reference to FIG. 9.

When the sheet taking operation is started after the sheet receiving or supply operation for the bins has completed, it is checked if the sheet taking operation is initiated by a signal from the copy machine A (which includes a signal from an automatic document feeder attached to the copy machine indicating that all the sheets are copied) or a signal from a switch (not shown) attached to the sorter 70 (ST1). If the signal comes from the copy machine, the step goes to the copy machine (ST101), and if the signal comes from the switch of the sorter 70, the switch is turned on (ST2) by operating the switch to start the taking operation.

Then, it is checked if the uppermost bin $\mathbf{80}_1$, i.e. all the bins 80, is located in the home position P1 (ST3). In case all the bins 80 are located in the home position P1, it is checked whether the sheets are located more than seven bins (ST4). In case of more than seven bins, it follows to step ST5, and in case of less than seven bins, it goes to step ST401.

Now, reference is made to the situation that the sheet receiving bins are more than seven, for example ten (all the bins).

In the step ST5, the driving motor 61 starts to operate, so that the spiral cams 101 rotate in the forward direction to transfer the bins 80 upwardly. The sheet stored in the uppermost bin $\mathbf{80}_1$ pushes the pivotable lever 91 of the sensor S10, so that the sector 93 of the lever 91 shuts off the light path of the photo coupler to thereby indicate the presence of the sheet (ST6). This condition is shown in dot-chain lines of FIG. 7 such that four bins $\mathbf{80}_1$–$\mathbf{80}_4$ are located in the sheet taking position P3. In this condition, the motor 61 stops (ST7). The operator can remove the sheets easily from the bins, wherein the bins are spaced apart at the bin distance L3 in the sheet taking position P3.

It is to be noted that a plurality of bins 80 (four in this embodiment) is located in the sheet taking position P3, and therefore, it is possible to take out the sheets from a plurality of bins 80 at the same time. It is also possible to take out the sheet from the bin 80 at the sheet receiving position P2. Thus, the sheet taking operation can be made easily and quickly.

When the sheets are removed from the bins 80, the pivotable lever 91 of the lever rotates about the support point 92, and the sector 93 opens the light path of the photo coupler 90 of the sensor S10 to thereby become non-sheet condition (ST8). Then, a timer operates (ST9), and when a predetermined time has passed, it returns to the step ST5. As a result, the spiral cams 101 rotate by the driving motor 61 to rise the bins 80 upwardly. When the sensor S10 detects the sheet on the bin 80 and the bins 80 rise upto the predetermined upper position, the upward movement of the bins is stopped. Namely, the sensor S10 operates to locate the bins having the sheet therein to the sheet taking position.

In case the operator can not await the counting up of the timer while the timer is actuated in the step ST9, it is possible to operate the motor 61 before counting up of the timer by actuating a removal switch as shown in the step ST9O1. Here, it is possible to quickly remove the sheets from the bins.

The bins 80 where the sheets are removed are gathered at the upper gathering position P4, as shown in dot-chain lines in FIG. 7. In the upper gathering position P4, the bins 80 are arranged with a minimum distance L4 as in the home position P1 (L4 nearly equals to L1), so that the sorter 70 can be made compact with a low cost without unnecessarily increasing the height.

If the sheet is taken out at the step ST6, in the step ST601, the sheet receiving bins (delete 1 from the total bin number), i.e. nine bins in this example, rise to confirm complete removal of the sheets, and the motor stops at the step ST10. In this condition, the bins $80_1$–$80_5$ are located at the upper gathering position P4, and the bins $80_6$–$80_9$ are located at the bin taking position P3. Then, it is confirmed that there is no sheet in all the bins 80 by the sensor S4 which is return signal means (ST11). The motor 61 operates by the signal from the sensor S4 (ST12) to descend the bins 80 to the home position Pi, and then the motor 61 stops (ST14), so that the series of operation are completed.

The above explanation is made based on the situation that the bin number for receiving the sheets is more than seven. If it is judged that the bin number for receiving the sheets is less than six at the step ST4, the procedure goes to the step ST401, wherein the bins 80 rise by the motor 61, as in the previous explanation. However, the lowest sheet receiving bin in the sheet receiving bins, for example the bin $80_6$ in case the sheet receiving bins are six, is positioned to the sheet receiving position P2, which is the uppermost position of the home position P1, and the rest of the sheet receiving bins are located in the sheet taking position P3. Thus, the sheets can be removed from the bins at once (ST402). Thereafter, the steps follow to the step ST10.

The above explanation is based on the situation that in step ST3, the bins 80 are all located in the home position P1. In case of the sorting where the sheets are supplied in the order of the pages, when the sheet distribution is completed at the odd number, the sheet receiving bins except for the lowermost sheet receiving bin are positioned at the sheet taking position P3 and possibly at the upper gathering position P4.

In this case, the step changes from the step ST3 to the step ST301, wherein the number of the sheet receiving bins is checked. In case the sheet receiving bins are less than six, it is possible to remove the sheets as they are. Thus, the sheets are removed, and then the step follows to the step ST11.

In case the number of the sheet receiving bins is more than seven, for example ten, the motor 61 rotates in the reverse direction (ST302) to turn the spiral cams 101 to descend five bins (ST303) and stops. Thus, the bins $80_1$–$80_5$ are located in the sheet taking position P3 to be able to remove the sheets from the bins. After the sheets are removed, if there is no sheet, the step goes to the step ST5. If a sheet is left, the process goes to the step ST7 to clear all the sheets.

In the present invention, the following modifications can be made in addition to the above first and second embodiments.

(1) Instead of the sheet presence sensor S4, return signal means may be formed at the sorter or the sheet supply machine so that the bin movement may be controlled manually.

(2) Return signal means may be formed by providing a timer to the distribution detecting means (feed/eject sensor S2 in the above example).

(3) A timer may be attached to the sheet presence detecting sensor S4 as the return signal means.

(4) Start signal means of the sheet supply machine may be used as bin return input means of the sorter.

(5) In the second embodiment, the sheet receiving bins are moved from the home position to the upper gathering position according to the detection of the sheet removal by the lever 91 and the sensor 90. In this case, the pivotable lever 91 may be actuated when detecting a sheet at the lowermost bin in the sheet taking position or the sheet receiving position, and the sheet receiving bins may be returned from the upper gathering position to the home position by the signal from the lever 91.

(6) In the second embodiment, the movement of the bins is controlled by detecting the number of the sheet receiving bins but, the sheet presence sensor S4 and the sheet detecting sensor S10 at the sheet taking position may be combined without checking the number of the sheet receiving bins. In this case, when the sensor S4 detects presence of the sheet, the bins may be moved upwardly until the sensor S10 is turned on. In case the sensor S4 is off, the signal from the sensor S4 is processed with priority to return the bins to the home position.

Figure 10:
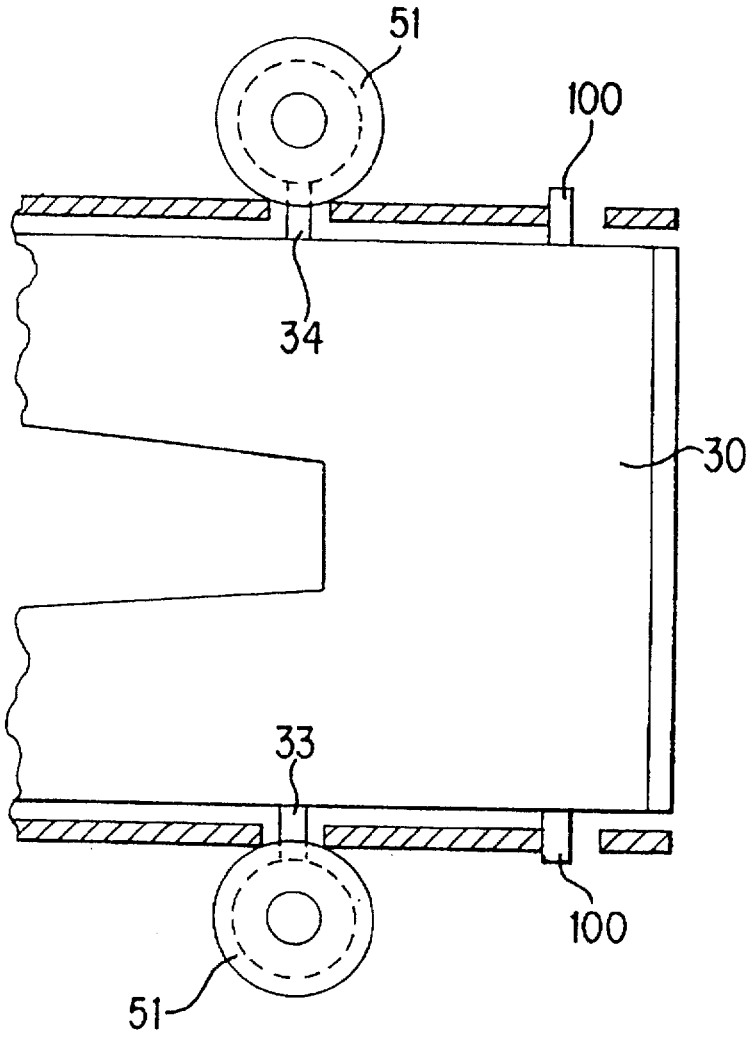
FIG. 10 is an explanatory view for a modified example of a moving mechanism of the bin.

(7) In the first embodiment, three spiral cams 51 are used for moving the bins up and down. However, as shown in FIG. 10, four pins may be formed on the right and left sides of the bin, wherein two pins are engaged with the cam grooves and the remaining two pins are engaged with rails of the frame. Consequently, the bins may be moved up and down by the two spiral cams.

(8) In the invention, the sorter may have a control device for comparing a size of a sheet received in the bin and a size of a sheet to be supplied through the distributing section when the start signal means is actuated. When the sizes are different, the sheet supply machine continues to operate, and when the size of the sheet to be supplied through the distributing section is the same as that of the sheet in the bin, sheet supply by the sheet supply machine is stopped.

In the present invention, the bins can be moved in the home position, the sheet receiving position and the sheet taking position, wherein the distance between the bins at the sheet taking position is greater than the distance between the bins at the home position and is less than the distance between the bins at the sheet receiving position. Thus, the sheet can be supplied to the bins efficiently, and the sheet on the bins can be taken out easily. Also, the sorter can be made compact.

In case the sorter has the upper gathering position above the sheet taking position and the sheet detecting means for the sheet taking position, the sorter can be further made compact.

While the invention has been explained with reference to the specific embodiments of the invention, the explanation is illustrative and the invention is limited only by the appended claims.

What is claimed is:

1. A sorter for receiving sheets supplied from a sheet supply machine, comprising:

a sheet distributing section for distributing sheets supplied from the sheet supply machine, a plurality of bins situated near the sheet distributing section for receiving the sheets from the sheet distributing section, said bins being arranged adjacent to each other and being movable relative to the sheet distributing section, means for positioning the bins to a home position, a sheet receiving position and a sheet taking position, and return signal means for actuating the positioning means electrically connected to the positioning means, said positioning means, when receiving a signal from the return signal means, positioning the bins to a predetermined position, said home position being located at one side relative to the sheet distributing section, wherein the bins are stacked adjacent to each other with a distance (L1), and all the bins can be located in the home position, said sheet receiving position facing the sheet distributing section to receive one of the sheets onto one of the bins, wherein a sheet receiving bin except a top bin is situated away from a bin located above the sheet receiving bin with a distance (L2), said sheet taking position being located at the other side opposite to the home position relative to the sheet receiving position, wherein a plurality of said bins is stacked adjacent to each other with a distance (L3) greater than the distance L1 and less than the distance (L2), at least one bin being located in the sheet taking position when the sheets are supplied to at least tow bins so that the sheets can be easily removed from the bins.

2. A sorter according to claim 1, wherein said positioning means, when the sorter is actuated, operates to move the bins from the home position to the sheet taking position through the sheet receiving position.

3. A sorter according to claim 1, wherein said return signal means actuates the positioning means such that when said positioning means receives the signal from the return signal means, the positioning means return bins in the sheet taking position to the home position.

4. A sorter according to claim 1, wherein said return signal means is sheet presence detecting means for detecting absence of the sheet from all the bins.

5. A sorter according to claim 1, wherein said return signal means is manual input means formed on one of the sorter and the sheet supply machine.

6. A sorter according to claim 1, wherein said return signal means is distribution detecting means with a timer formed on one of the sorter and the sheet supply machine, said distribution detecting means, upon detection of a sheet at the distributing section, starting to count a time so that when the time is counted up, the detecting means outputs a signal for completing a sheet distribution.

7. A sorter according to claim 1, wherein said return signal means is distribution detecting means with a timer, said distribution detecting means detecting absence of the sheet from all the bins, said timer, upon detection of the absence of the sheet, starting to count a time so that when the time is counted up, the detecting means outputs the signal to operate the positioning means.

8. A sorter according to claim 1, wherein said sheet supply machine includes start signal means, which operates as said return signal means.

9. A sorter according to claim 8, further comprising a control device, said control device comparing a size of a sheet received in the bin and a size of a sheet to be supplied through the distributing section when the start signal means is actuated, and actuating such that when the sizes are different, the sheet supply machine continues to operate, and when the size of the sheet to be supplied through the distributing section is same as that of the sheet in the bin, sheet supply by the sheet supply machine is stopped.

10. A sorter according to claim 2, wherein said bins are arranged vertically so that the home position is located lower than the sheet taking position.

11. A sorter according to claim 10, wherein said positioning means includes a driving device located in a space under a lowermost bin at the home position.

12. A sorter according to claim 11, wherein each bin includes a plurality of engaging pins, and said positioning means includes a plurality of spiral cams rotationally situated in a frame of the sorter and driven by the driving device, said engaging pins engaging the spiral cams so that when the driving device operates, the bins are moved by the spiral cams.

13. A sorter according to claim 12, wherein each bin is inclined such that a side of the bin near the distributing section is lower that the other side of the bin.

14. A sorter according to claim 1, further comprising sheet presence detecting means for detecting whether a sheet is placed on the bin at the sheet taking position, and a control device, said control device, when confirmed by the sheet presence detecting means that the sheet is taken out from the bin at the sheet taking position, actuating the positioning means to move another bin with a sheet to the sheet taking position.

15. A sorter according to claim 1, wherein each bin includes a plurality of engaging pins, and said positioning means includes a plurality of spiral cams rotationally situated in a frame of the sorter, each spiral cam having a groove engaging the engaging pins of the bins, each groove having different pitches for forming the distances (L1), (L2) and (L3) in the respective positions of the bins so that when the spiral cams rotate, the bins are moved vertically for the predetermined distances away from each other.

16. A sorter according to claim 15, wherein each bin includes four engaging pins, and said positioning means includes two spiral cams rotationally situated in the frame, two engaging pins engaging the grooves of the spiral cams and two engaging pins engaging rails of the frame.

* * * * *